US011655519B2

(12) United States Patent
Watson et al.

(10) Patent No.: US 11,655,519 B2
(45) Date of Patent: May 23, 2023

(54) THERMAL CYCLING FOR AUSTENITE GRAIN REFINEMENT

(71) Applicant: NUCOR CORPORATION, Charlotte, NC (US)

(72) Inventors: James W. Watson, Brownsburg, IN (US); Paul Kelly, Mount Kembla (AU); Mike Schueren, Crawfordsville, IN (US); Walter N. Blejde, Brownsburg, IN (US)

(73) Assignee: NUCOR CORPORATION, Charlotte, NC (US)

( * ) Notice: Subject to any disclaimer, the term of this patent is extended or adjusted under 35 U.S.C. 154(b) by 165 days.

(21) Appl. No.: 16/488,437

(22) PCT Filed: Feb. 27, 2018

(86) PCT No.: PCT/US2018/019967
§ 371 (c)(1),
(2) Date: Aug. 23, 2019

(87) PCT Pub. No.: WO2018/157136
PCT Pub. Date: Aug. 30, 2018

(65) Prior Publication Data

US 2020/0063235 A1 Feb. 27, 2020

Related U.S. Application Data

(60) Provisional application No. 62/464,355, filed on Feb. 27, 2017.

(51) Int. Cl.
*C21D 9/52* (2006.01)
*C22C 38/48* (2006.01)
(Continued)

(52) U.S. Cl.
CPC ..... *C21D 9/52* (2013.01); *B22D 11/001* (2013.01); *B22D 11/0622* (2013.01);
(Continued)

(58) Field of Classification Search
None
See application file for complete search history.

(56) References Cited

U.S. PATENT DOCUMENTS 4,170,499 A 10/1979 Thomas et al.
6,027,587 A 2/2000 Hodgson et al.
(Continued)

FOREIGN PATENT DOCUMENTS

CA 2701903 A1 4/2009
EP 1025272 A1 8/2000
(Continued)

OTHER PUBLICATIONS

Effect of Prior Austenite grain size refinement by thermal cycling on the microstructural features of As-quenched lath martensite Javier Hidalgo and Maria Jesus Santofimia Metallurgical and Materials Transactions vol. 47A, Nov. 2016 (Year: 2016).*
(Continued)

*Primary Examiner* — Jenny R Wu
(74) *Attorney, Agent, or Firm* — Hahn Loeser & Parks LLP

(57) ABSTRACT

This application discloses thin metal strips and methods of making thin metal strip. Particular embodiments of such methods include cooling the thin metal strip to a temperature equal to or less than a bainite or a martensite start transformation temperature $B_S$ or $M_S$ to thereby form bainite and/or martensite, respectively, within the thin metal strip, reheating the thin metal strip to a reheat temperature equal to or greater than transformation temperature $Ac_3$ and holding the thin metal strip at the reheat temperature for at least 2
(Continued)

seconds and thereby forming austenite within the thin metal strip with at least 75% of austenite grains having a grain size equal to or less than 15 μm, and rapidly recooling the thin metal strip to a temperature equal to or less than the martensite start transformation temperature $M_S$ and thereby providing finer martensite within the thin metal strip from a finer prior austenite.

21 Claims, 8 Drawing Sheets

(51) Int. Cl.

| | |
|---|---|
| ***C22C 38/44*** | (2006.01) |
| ***C22C 38/42*** | (2006.01) |
| ***C22C 38/06*** | (2006.01) |
| ***C22C 38/04*** | (2006.01) |
| ***C22C 38/02*** | (2006.01) |
| ***B22D 11/00*** | (2006.01) |
| ***B22D 11/06*** | (2006.01) |
| ***B22D 11/12*** | (2006.01) |
| ***C21D 6/00*** | (2006.01) |
| ***C21D 1/18*** | (2006.01) |
| ***C22C 38/46*** | (2006.01) |

(52) U.S. Cl.

CPC ..... *B22D 11/1213* (2013.01); *C21D 1/18* (2013.01); *C21D 6/004* (2013.01); *C21D 6/005* (2013.01); *C21D 6/008* (2013.01); *C22C 38/02* (2013.01); *C22C 38/04* (2013.01); *C22C 38/06* (2013.01); *C22C 38/42* (2013.01); *C22C 38/44* (2013.01); *C22C 38/46* (2013.01); *C22C 38/48* (2013.01); *C21D 2211/008* (2013.01)

(56) References Cited

U.S. PATENT DOCUMENTS

| | | | | |
|---|---|---|---|---|
| 6,190,469 | B1 | 2/2001 | Koh et al. | |
| 6,251,198 | B1 | 6/2001 | Koo et al. | |
| 6,264,760 | B1 * | 7/2001 | Tamehiro ..... | C21D 8/0226 148/336 |
| 2002/0043357 | A1 | 4/2002 | Strezov et al. | |
| 2004/0149362 | A1 | 8/2004 | Kusinski et al. | |
| 2009/0098408 | A1 | 4/2009 | Sun | |
| 2009/0149362 | A1 | 6/2009 | Kalidindi | |
| 2009/0301613 | A1 | 12/2009 | Koo et al. | |
| 2010/0186856 | A1 | 7/2010 | Williams et al. | |
| 2011/0139315 | A1 | 6/2011 | Nakagaito et al. | |
| 2011/0277886 | A1 | 11/2011 | Xie et al. | |
| 2012/0132323 | A1 | 5/2012 | Killmore et al. | |
| 2012/0204994 | A1 | 8/2012 | Anelli et al. | |
| 2013/0302644 | A1 | 11/2013 | Edelman et al. | |
| 2015/0007913 | A1 | 1/2015 | Wang et al. | |
| 2015/0360285 | A1 | 12/2015 | Dorner et al. | |
| 2016/0177411 | A1 | 6/2016 | Watson et al. | |
| 2016/0215359 | A1 | 7/2016 | Eguchi et al. | |
| 2017/0137908 | A1 | 5/2017 | Fan et al. | |

FOREIGN PATENT DOCUMENTS

| | | | |
|---|---|---|---|
| JP | 01162723 | A | 6/1989 |
| JP | 02236224 | A | 9/1990 |
| JP | 02236228 | A | 9/1990 |
| JP | 04200801 | A | 7/1992 |
| WO | 9513155 | A1 | 5/1995 |
| WO | 90/05335 | A1 | 2/1999 |
| WO | 2016100839 | A1 | 6/2016 |

OTHER PUBLICATIONS

The Rapid Heat Treatment of Steel R.A. Grange Metallurgical Transactions vol. 2, Jan. 1971-65 (Year: 1971).*

Effect of Copper on Tensile Properties and Grain-Refinement of Steel and its Relation to Precipitation Behavior Setuo Takaki, Masaaki Fujioka, Shuji Aihara, Yasunobu Nagataki, Takako Yamashita, Naoyuki Sano, Yoshitaka Adachi;*, Masahiro Nomura and Hiroshi Yaguchi Materials Transactions, vol. 45, No. 7.*

PCT/US2018/019967 International Search Report and Written Opinion dated May 4, 2018, 12 pages.

Extended European Search Report for European Patent Application No. 18758150.9 dated Oct. 25, 2019, 9 pages.

Australian Patent Office International-Type Search Report for Provisional Patent Application No. 2017902426 dated Aug. 17, 2017, 10 pages.

"Fundamentals of the Heat Treating of Steel", Practical Heat Treating, Second Edition, ASM International, pp. 9-25, 2006, 17 pages.

* cited by examiner

| Re-austenitize Temp deg C | Prior Austenite grain size (um) at different holding times (s) | | |
|---|---|---|---|
| | 2 sec | 10 sec | 20 sec |
| 775 | Not fully austenitized | Not fully austenitized | Not fully austenitized |
| 800 | Not fully austenitized | 6 um | 8 um |
| 825 | 4 um | 6 um | 9 um |

FIG. 2

| Holding time at 825 deg C (sec) | VICKERS HARDNESS | | | | |
|---|---|---|---|---|---|
| | HV5 | HV5 | HV10 | HV10 | HV10 |
| 2 | 549 | 549 | 599 | 569 | 569 |
| 10 | 524 | 524 | 525 | 493 | 483 |
| 20 | 487 | 466 | 505 | 572 | 503 |

FIG. 3

THERMAL CYCLING FOR AUSTENITE GRAIN REFINEMENT

CROSS-REFERENCE TO RELATED APPLICATIONS

This application claims priority to, and the benefit of, U.S. provisional patent application No. 62/464,355, filed Feb. 27, 2017 with the U.S. Patent Office, which is hereby incorporated by reference.

BACKGROUND AND SUMMARY

This invention relates to metal compositions having finer martensite from finer prior austenite, and in particular embodiments, where these metal compositions comprise cast steel strip produced by continuous casting with a twin roll caster.

In a twin roll caster, molten metal is introduced between a pair of counter-rotated casting rolls that are cooled so that metal shells solidify on the moving roll surfaces and are brought together at a nip between them. The term "nip" is used herein to refer to the general region at which the rolls are closest together. The molten metal may be delivered from a ladle into a smaller vessel or series of smaller vessels from which it flows through a metal delivery nozzle located above the nip, forming a casting pool of molten metal supported on the casting surfaces of the rolls immediately above the nip and extending along the length of the nip. As the metal shells are joined and pass through the nip between the casting rolls, a thin metal strip is cast downwardly from the nip.

Although twin-roll casting has been applied with some success to non-ferrous metals which solidify rapidly on cooling, there have traditionally been problems in applying the technique to the casting of ferrous metals. For example, while developments now permit steel strip to be cast continuously without breakages and major structural defects, because the steel strip exits the caster at high temperatures, typically in excess of 1200° C., it is produced with a very coarse-grained austenitic structure which can, on further cooling without refining, lead to a strip with more limited ductility that may be prone to hydrogen embrittlement. Before rolling, the as produced strip cast metal strips consist of austenite having a majority of grains measuring 100 to 300 microns. If said strip is then quenched to form martensite, this martensite originating from the coarser austenite may be prone to hydrogen embrittlement and may have material properties that are less desirable in certain instances.

By the present invention, it is possible to modify the metallurgical structure of the thin metal strip as it is produced by a continuous strip caster so as to produce a final strip product comprising martensitic steel having low susceptibility to hydrogen embrittlement and having other desirable material properties.

Particular embodiments of this disclosure include a method of making thin metal strip with finer martensite from finer prior austenite comprising:

providing a pair of counter-rotatable casting rolls having casting surfaces laterally positioned to form a gap at a nip between the casting rolls through which a thin metal strip having a thickness of less than 5 mm can be cast, providing a metal delivery system adapted to deliver molten metal above the nip to form a casting pool, the casting pool being supported on the casting surfaces of the pair of counter-rotatable casting rolls and confined at the ends of the casting rolls, delivering a molten metal to the metal delivery system to produce a thin metal strip comprising the following composition: by weight, between 0.20% and 0.35% carbon, less than 1.0% chromium, less than 1.0% nickel, between 0.7% and 2.0% manganese, between 0.10% and 0.50% silicon, between 0.1% and 1.0% copper, less than 0.08% niobium, less than 0.08% vanadium, less than 0.5% molybdenum, silicon killed with less than 0.01% aluminum;

delivering the molten metal from metal delivery system above the nip to form the casting pool;

counter rotating the pair of counter-rotatable casting rolls to form metal shells on the casting surfaces of the casting rolls that are brought together at the nip to deliver the thin metal strip downwardly, the thin metal strip having a thickness less than 5 mm, cooling the thin metal strip to a temperature equal to or less than a bainite or a martensite start transformation temperature $B_S$ or $M_S$ to thereby form bainite and/or martensite, respectively, within the thin metal strip, reheating the thin metal strip to a reheat temperature equal to or greater than transformation temperature $Ac_3$ and holding the thin metal strip at the reheat temperature for at least 2 seconds and thereby forming austenite within the thin metal strip with at least 75% of austenite grains having a grain size equal to or less than 15 μm, and rapidly recooling the thin metal strip to a temperature equal to or less than the martensite start transformation temperature $M_S$ and thereby providing finer martensite within the thin metal strip from a finer prior austenite, where at least 75% of finer prior austenite grains have a grain size equal to or less than 15 μm.

Further embodiments of this disclosure include a thin metal strip comprising:

a thickness less than 5 mm;

by weight, between 0.20% and 0.35% carbon, less than 1.0% chromium, less than 1.0% nickel, between 0.7% and 2.0% manganese, between 0.10% and 0.50% silicon, between 0.1% and 1.0% copper, less than 0.08% niobium, less than 0.08% vanadium, less than 0.5% molybdenum, silicon killed with less than 0.01% aluminum;

martensite characterized as having at least 75% of prior austenite grains having a grain size equal to or less than 15 μm.

BRIEF DESCRIPTION OF THE DRAWINGS

FIG. 2 is a chart showing the grain sizes achieved for prior austenite when martensitic steel is reheated to a particular reheat temperature (the "Reaustenitized Temp") for particular durations.

FIG. 3 is a chart showing particular Vicker hardness test results achieved for particular reheating and rapid recooling processes conducted at 825° C. for different durations.

DETAILED DESCRIPTION

Figure 1A:
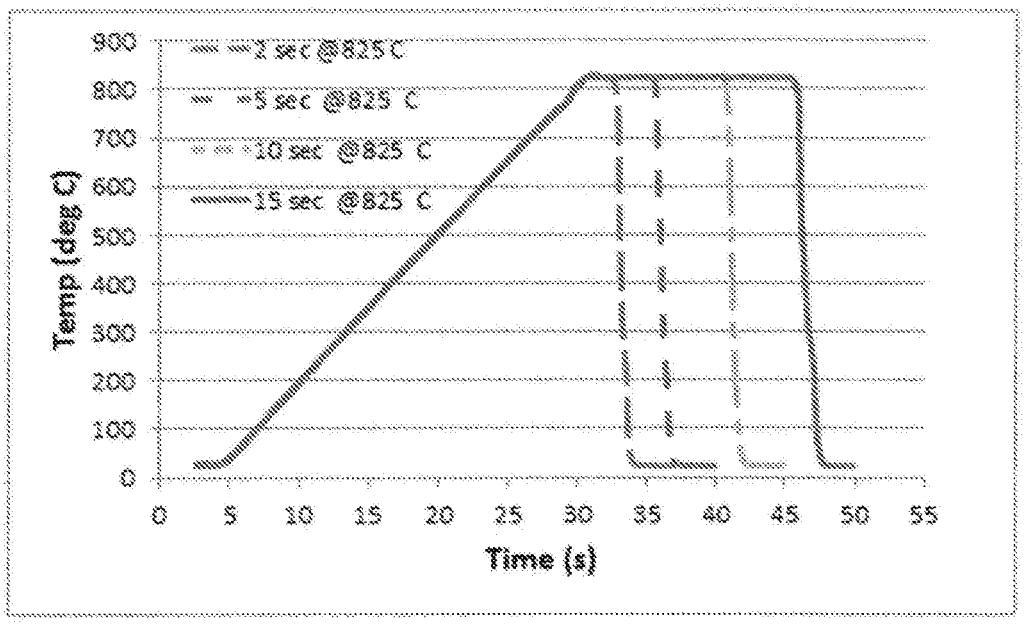
FIG. 1A is a graph showing a plot of temperature versus time for four (4) different reheating and rapid recooling processes, in accordance with certain exemplary embodiments.

Described herein are methods for producing thin metal strip of finer martensite and is characterized as having prior austenite grain sizes of 15 microns ("μm" or "micrometers") or less. This quantification of grain size, as well as the quantification of any grain size herein, is considered a maximum linear dimension measured across a corresponding grain. In summary, a thin metal strip is first formed to include bainite and/or martensite. Subsequently, the thin metal strip of bainite and/or martensite is reheated to re-form austenite (that is, it is "reaustenized"). Thereafter, the thin metal strip containing re-formed austenite is rapidly cooled or quenched to achieve a finer martensitic thin metal strip having refined (that is, reduced) grain sizes as compared to grains of the original martensitic microstructure.

In particular embodiments, the method for producing a thin martensitic steel strip includes:

(1) forming a thin metal strip of steel having a thickness less than 5 mm;

(2) cooling the thin metal strip to a temperature equal to or less than a bainite start transformation temperature $B_S$ and/or martensite start transformation temperature $M_S$ to thereby form bainite and/or martensite, respectively, within the thin metal strip (resulting in a cooled thin metal strip);

(3) reheating the thin metal strip (that is, the cooled thin metal strip containing bainite and/or martensite) to a reheat temperature equal to or greater than a transformation temperature $Ac_3$ to form austenite within the thin metal strip, where for the austenite, at least 75% (that is, equal to or greater than 75%) of its grains have a grain size equal to or less than 15 μm; and, (4) rapidly recooling the thin metal strip to a temperature equal to or less than the martensite start transformation temperature $M_S$ and thereby providing finer martensite within the thin metal strip from a finer prior austenite having at least 75% of its grains having a grain size equal to or less than 15 μm, where as a result of rapid recooling, the thin metal strip transforms into a thin martensitic steel strip.

It is appreciated that the composition forming the thin martensitic steel strip may form any of a variety of steels or steel alloys. For example, in particular embodiments, the composition of the thin metal strip includes the following: by weight, between 0.20% and 0.35% carbon, less than 1.0% chromium, less than 1.0% nickel, between 0.7% and 2.0% manganese, between 0.10% and 0.50% silicon, between 0.1% and 1.0% copper, less than 0.08% niobium, less than 0.08% vanadium, less than 0.5% molybdenum, silicon killed with less than 0.01% aluminum. The remainder of the content may comprise any other material if at all, including, without limitation, iron and other impurities that may result from melting.

With regard to cooling the thin metal strip to a temperature equal to or less than a bainite and/or a martensite start transformation temperature to thereby form bainite and/or martensite, respectively, (which is referred to as the original cooled structure), in certain variations, the temperature to which the thin metal strip is cooled is equal to or less than 600° C. It is appreciated that this cooling to bainite and/or martensite may be achieved in any desired manner. In particular instances, for example, this original cooled structure is formed by quenching the thin metal strip after it is initially formed from molten steel. It is appreciated that this cooling initiates when the steel is in an austenite phase. It is stressed, however, that it is important that the thin metal strip be cooled to include bainite and/or martensite, as opposed to other low temperature phases, such as ferrite or pearlite, as the reheating must initiate when the thin metal strip is bainitic and/or martensitic (that is, when it includes bainite and/or martensite, respectively). This is because it is believed that a higher, and more even distribution of a carbon within the bainitic and/or martensitic microstructure operate as nucleation sites that facilitate the desired grain formations, in frequency and distribution, when reaustentizing the thin metal strip.

With regard to reheating of the thin metal strip, the thin metal strip is reheated to a reheat temperature equal to or greater than a transformation temperature $Ac_3$ and is held at the reheat temperature for at least 2 seconds, and thereby forms austenite within the thin metal strip, where at least 75% of the austenite grains have a grain size equal to or less than 15 μm. It is appreciated that any retained austenite from the initial (prior) cooling step should be minimized to less than 1%. This reheating is also referred to as reaustenization. By controlling this reheating, the finer austenite grain structure is achieved, which results in newly formed austenite having grain sizes of 15 μm or less. In certain exemplary embodiments, reheating is performed at a reheating temperature equal to or greater than 750° C. for a duration of at least 2 seconds. In other variations, the reheat temperature may reach 900° C. and/or any reheat temperature may be maintained for a duration of up to 20 seconds. Other combinations of temperatures and durations may also be employed to generate austenite as a result of reheating the thin metal strip.

With regard now to rapidly recooling the thin metal strip to a temperature equal to or less than the martensite start transformation temperature $M_S$, finer martensite is achieved within the thin metal strip from a finer prior austenite having grain sizes of ≤15 μm. It is appreciated that this rapid recooling may comprise any desired rate that results in transforming the austenitic thin metal strip into a martensitic steel structure comprising at least 75% martensite. For example, in certain instances, rapid recooling comprises quenching at a quenching rate of 700° C. per second (° C./s). In other instances, the quenching rate is equal to or greater than 100° C./s. Further, it is appreciated that the recooling temperature may be less than 200° C., less than 100° C., or between 0° C. and 100° C. in certain instances. It is also appreciated that prior austenite grains may be achieved that are equal to or less than 10 μm or equal to or less than 5 μm.

Figure 1B:
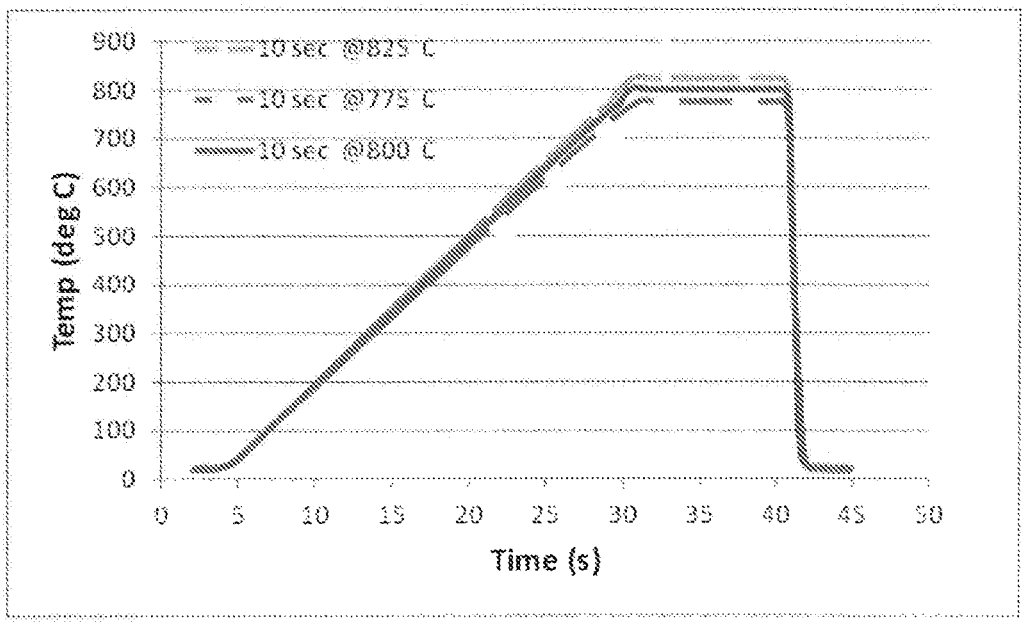
FIG. 1B is a graph showing a plot of temperature versus time for three (3) different reheating and rapid recooling processes, in accordance with additional exemplary embodiments.
Figure 4:
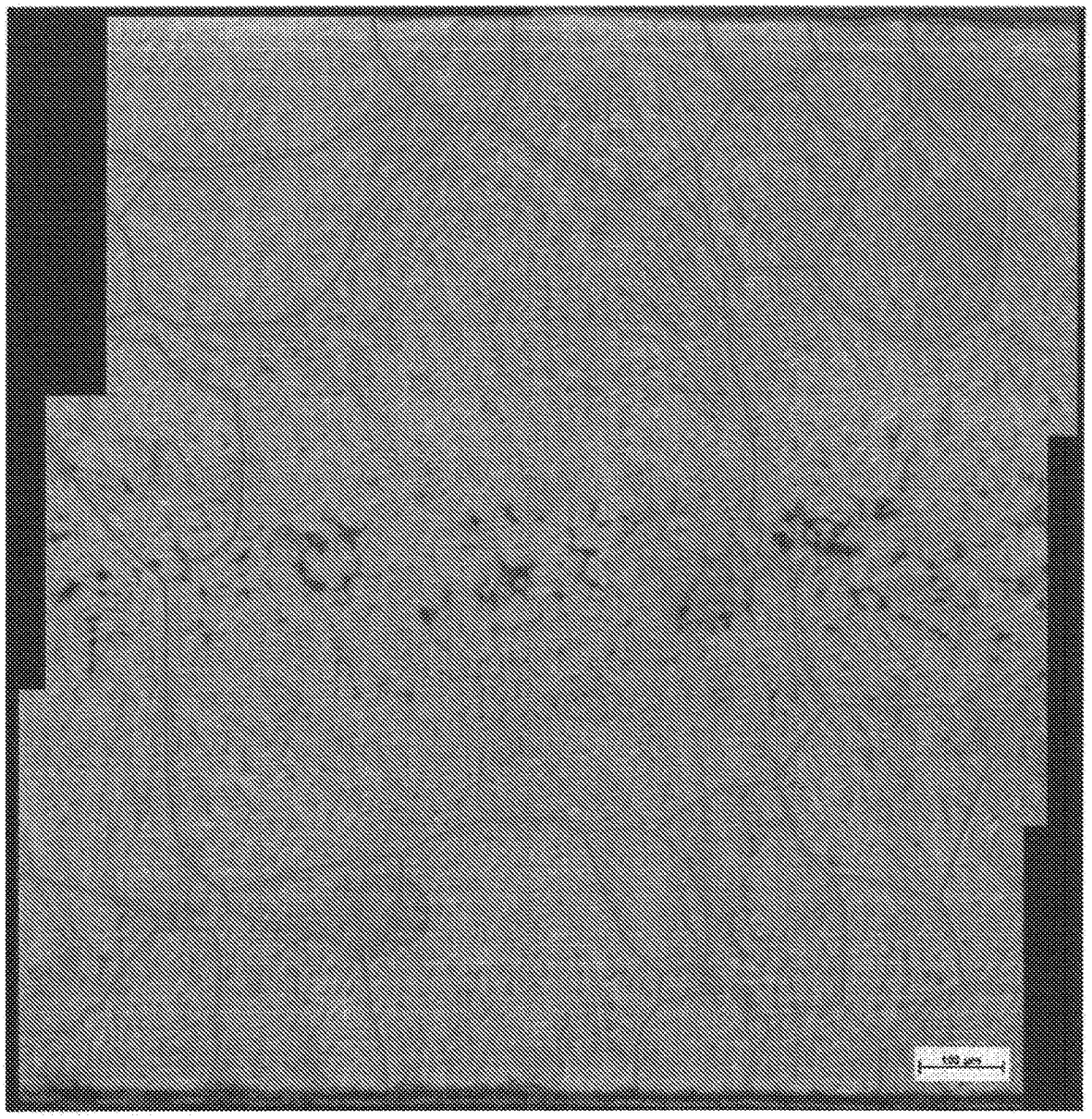
FIG. 4 is an edited image showing grain boundary sizes of prior austenite of a martensitic steel that has not undergone any reheating or recooling processes, where the scale included is 100 microns.
Figure 5:
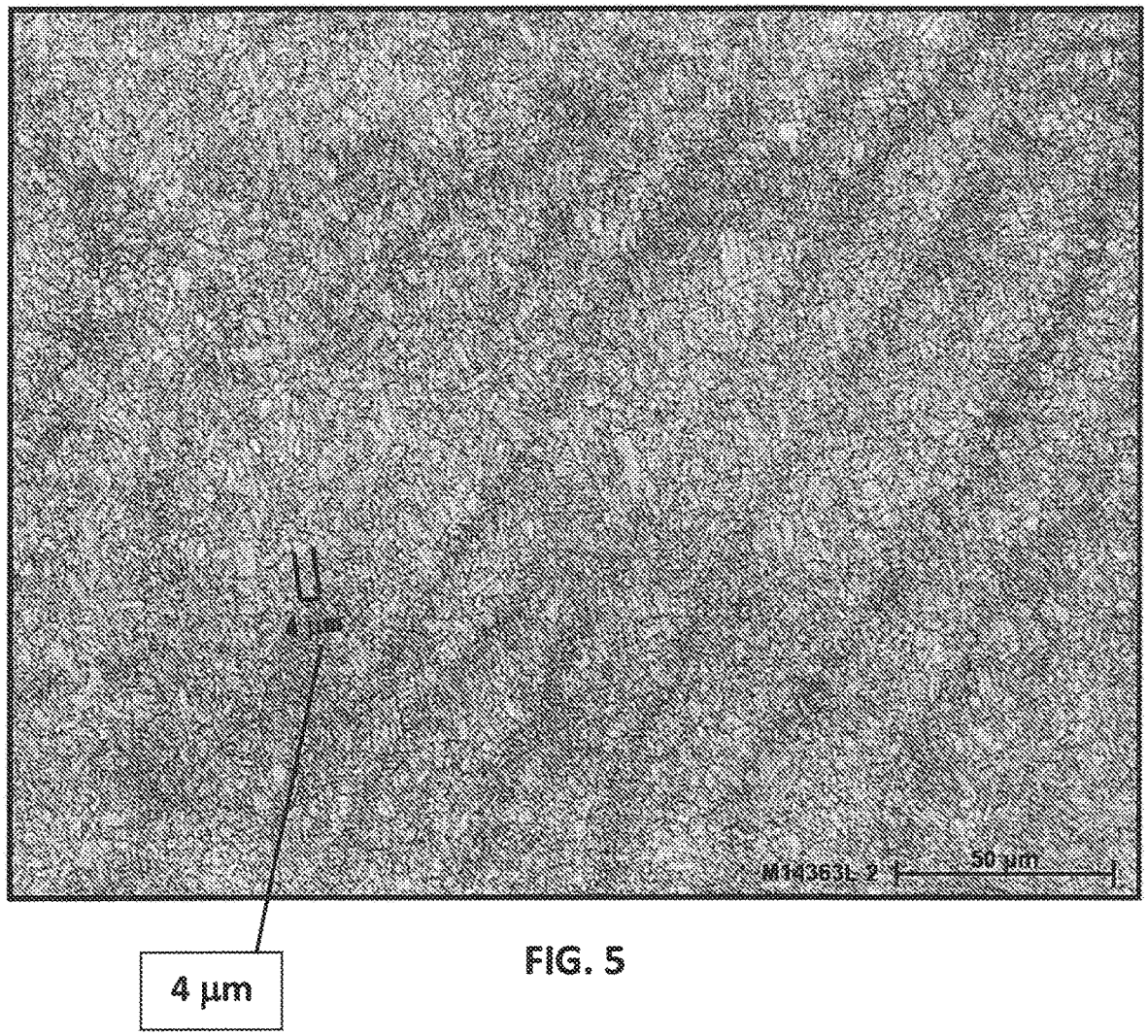
FIG. 5 is an edited image showing grain boundary sizes of finer prior austenite of a finer martensitic steel that has undergone reheating and rapid recooling processes where martensitic steel was reheated to 825° C. for two (2) seconds, the scale included being 50 microns and where a 4 micron grain is identified.
Figure 6:
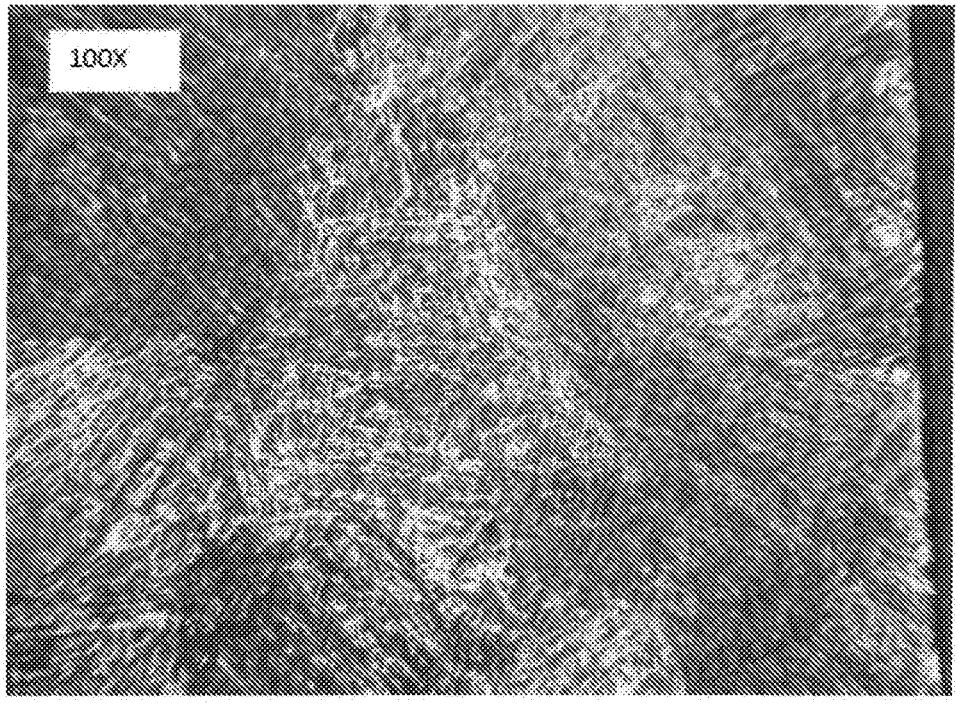
FIG. 6 is an image showing grain boundary sizes of prior austenite of a martensitic steel that has not undergone any reheating or recooling processes, where the image is shown at 100× magnification.
Figure 7:
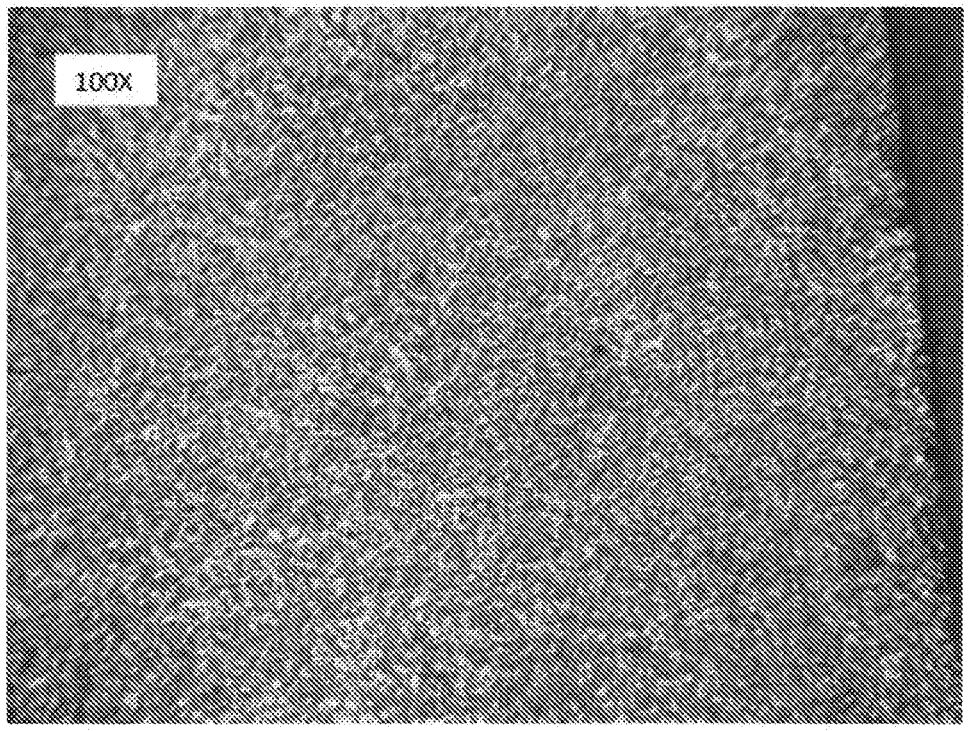
FIG. 7 is an image showing grain boundary sizes of finer prior austenite of a finer martensitic steel that has undergone reheating and rapid recooling processes where martensitic steel was reheated to 825° C. for two (2) seconds, where the image is shown at 100× magnification.

By way of illustration, with reference to FIGS. 1A and 1B, specific reheating and rapid recooling methods are described in accordance with particular embodiments. The results of certain reheating and rapid recooling methods described in FIGS. 1A and 1B, as applied to steel thin metal strips having a thickness measuring less than 5 mm and comprising a steel composition including 0.20 C, 1.0 Mn, 0.15 Si, 0.1 Ni, 0.49 Cr, 0.20 Mo and 0.19 Nb, are summarized in FIG. 2. In certain embodiments described therein, reheating of a thin metal strip is achieved by maintaining a reheat temperature of 825° C. for 2 seconds, which has been found, after quenching, to generate prior austenite grains of 4 μm (see FIG. 5). In other embodiments described therein, the reheating of a thin metal strip is achieved by maintaining a reheat temperature of 800° C. or 825° C. for 10 seconds, which has been found in each instance, after quenching, to generate prior austenite grains of 6 μm. In yet additional embodiments described therein, the reheating of a thin metal strip is achieved by maintaining a reheat temperatures of 800° C. or 825° C. for 20 seconds, which has been found in each instance, after quenching, to generate prior austenite grains of 8 μm and 9 μm, respectively. For each embodiment described above, the reheated thin metal strip was recooled by quenching at a rate of 700° C. per second (° C./s) to a temperature between 0° C. and 100° C. For comparison purposes, with reference to FIG. 4, the martensitic microstructure of the thin metal strip without reheating and recooling included prior austenite grains measuring 100 to 300 μm. With reference to FIGS. 6 and 7, prior austenite and its grains are shown in FIG. 6 that have not undergone any reheating (reaustenization) and recooling while finer prior austenite grains are shown in FIG. 7 after having been reaustenized by reheating to 925° C. and holding for 10 seconds (from a bainitic or martensitic structure in a reheating step, where the bainitic and/or martensitic structure had been formed after performing a cooling step as contemplated herein from an austenitic structure) followed by water quenching to recool the reaustenized thin metal strip to a temperature below 100 C.

It is appreciated that, in particular embodiments, the thin metal strip is formed using a strip casting operation, where the thin metal strip has a thickness measuring less than 5 mm. For example, in certain variations, a strip casting operation comprises:

(1) providing a pair of counter-rotatable casting rolls having casting surfaces laterally positioned to form a gap at a nip between the casting rolls through which a thin metal strips having a thickness of less than 5 mm can be cast;
(2) providing a metal delivery system adapted to deliver molten metal above the nip to form a casting pool, the casting pool being supported on the casting surfaces of the pair of counter-rotatable casting rolls and confined at the ends of the casting rolls;
(3) delivering a molten metal to the metal delivery system;
(4) delivering the molten metal from metal delivery system above the nip to form the casting pool; and,
(5) counter rotating the pair of counter-rotatable casting rolls to form metal shells on the casting surfaces of the casting rolls that are brought together at the nip to deliver the thin metal strips downwardly, the thin metal strips having a thickness less than 5 mm.

As noted previously, the thermal cycling methods discussed herein (that is, the process of cooling a thin metal strip from an austenite structure to bainite and/or martensite, reheating to reaustenize the thin metal strip, and then rapidly recooling to form martensite as contemplated herein) are intended to form thin martensitic steel strips characterized as having particular grain sizes as contemplated herein that result in a reduced susceptibility to hydrogen embrittlement. Additionally, the thin martensitic steel strips also exhibit improved material properties. For example, with reference to the embodiments discussed previously, where a reheat temperature of 825° C. was employed to a steel of composition including 0.20 C, 1.0 Mn, 0.15 Si, 0.1 Ni, 0.49 Cr, 0.20 Mo and 0.19 Nb, Vickers hardness measurements were obtained as provided in FIG. 3, where HV5 reflects Vickers hardness tests performed using a 5 kilogram-force (kgf) load and where HV10 reflects Vickers hardness tests performed using a 10 kgf load. It is noted that a Vicker hardness around 500 indicates that the microstructure is predominantly martensitic (that is, contains at least 75% by volume martensite). Additionally, these thin martensitic steel strips have also exhibited an increase in yield strength, tensile strength, and elongation after thermal cycling. For example, in certain instances, thin martensitic steel strips including 0.20 C, 1.0 Mn, 0.15 Si, 0.1 Ni, 0.49 Cr, 0.20 Mo and 0.19 Nb observed an increase in yield strength from 1022 MPa (Mega Pascals) to 1199 MPa, an increase in tensile strength from 1383 MPa to 1595 MPa, and an increase in elongation from 3.9% to 5%. Stated differently, due to the thermal cycling methods described herein, the yield strength increases at least 17%, the tensile strength increases by at least 15%, and the elongation increases by at least 28%. In obtaining the results noted previously in this paragraph, the results were obtained by cooling austenite to form martensite, and reheating to form austentite having grains equal to or less than 15 micrometers, and rapidly recooling to form martensite having prior austenite grains equal to or less than 15 micrometers.

To further illustrate particular embodiments of the methods described above, reference is now made to the drawings.

Figure 9:
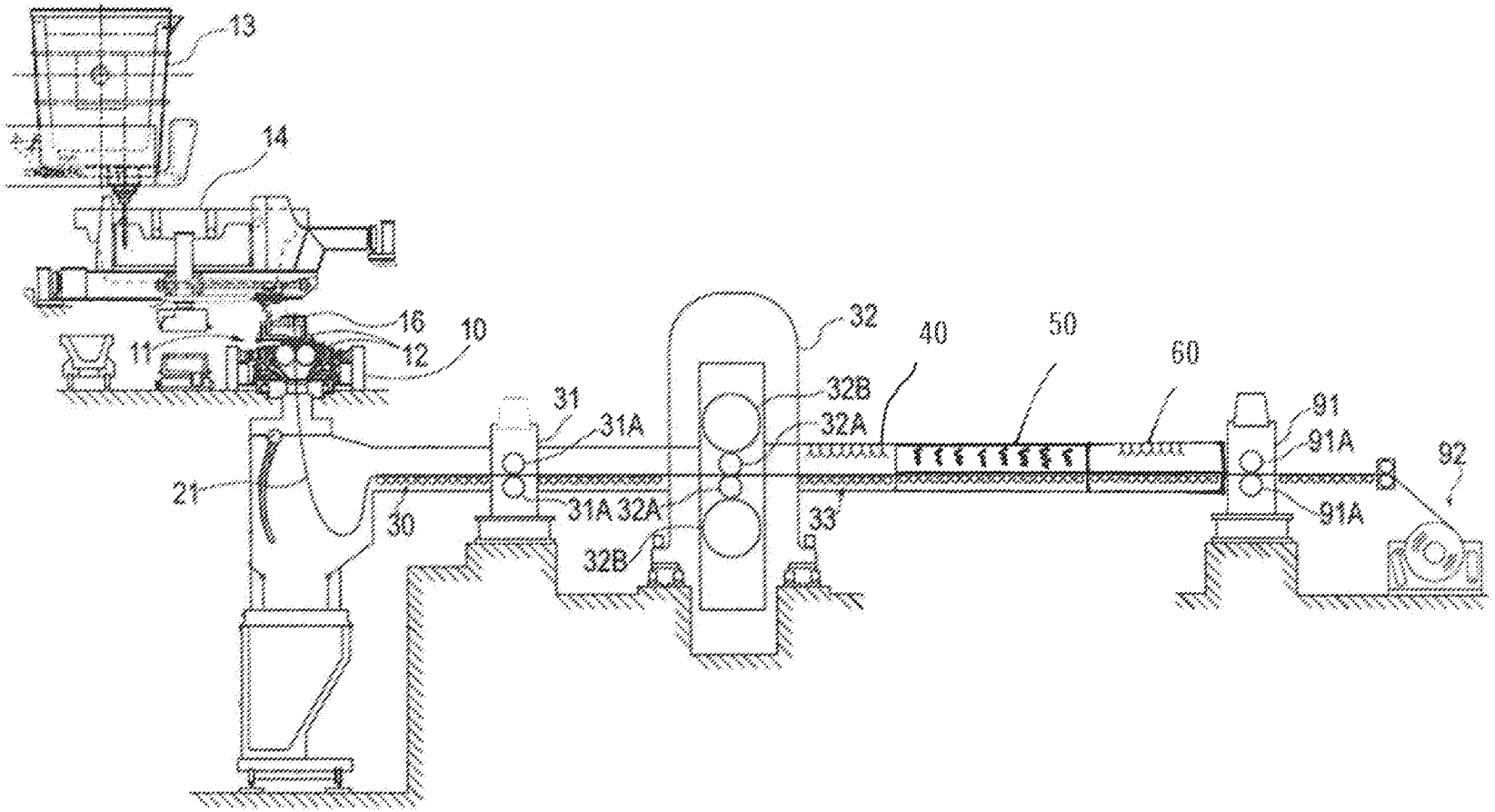
FIG. 9 is a side view of a twin roll caster used in particular embodiments to form thin metal strips.
Figure 10:
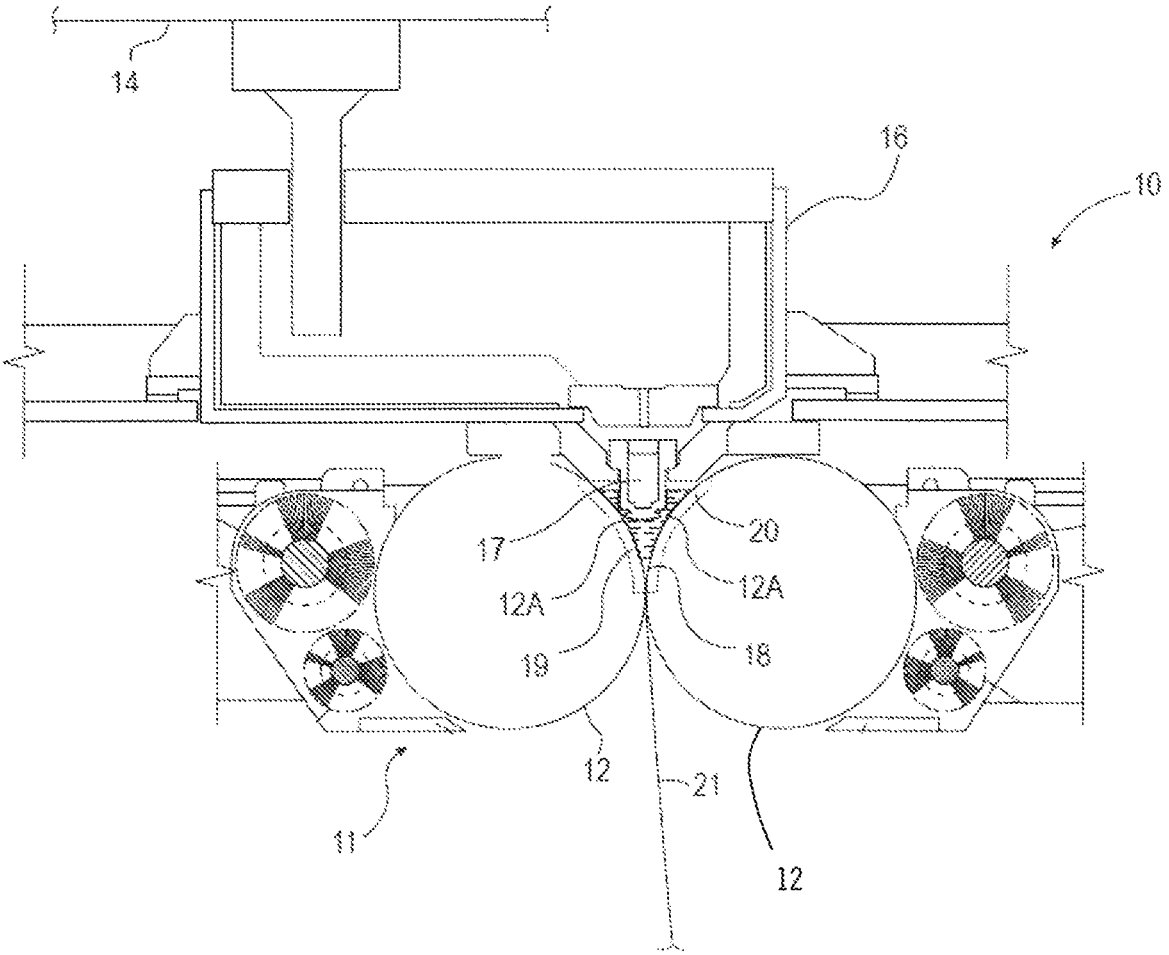
FIG. 10 is a partial cross-sectional view through a pair of casting rolls mounted in a continuous twin roll caster system.

As noted previously, the thin metal strips may be formed by a strip casting operation, and as such may employ any strip casting system. With reference to FIGS. 9 and 10, an exemplary strip casting system is shown. In this embodiment, the strip casting system is a continuous twin roll casting system. The twin roll caster comprises a main machine frame 10 that that stands up from the factory floor and supports a roll cassette module 11 including a pair of counter-rotatable casting rolls 12 mounted therein. With particular reference to FIG. 10, the casting rolls 12 having casting surfaces 12A laterally positioned to form a nip 18 there between. Molten metal is supplied from a ladle 13 through a metal delivery system of conventional arrangement, including a movable tundish 14 and a transition piece or distributor 16, where the molten metal flows to at least one metal delivery nozzle 17 positioned between the casting rolls 12 above the nip 18. Molten metal discharged from the delivery nozzle 17 forms a casting pool 19 of molten metal above the nip 18 supported on the casting surfaces 12A of the casting rolls 12. This casting pool 19 is laterally confined in the casting area at the ends of the casting rolls 12 by a pair of side closures or plate side dams 20 (shown in dotted line in FIG. 10).

With continued reference to FIG. 10, the casting rolls 12 are internally water cooled so that as the casting rolls 12 are counter-rotated, shells solidify on the casting surfaces 12A as the casting rolls move into and through the casting pool 19 with each revolution of the casting rolls 12. The shells are brought together at the nip 18 between the casting rolls 12 to produce solidified thin cast strip product 21 delivered downwardly from the nip 18. The gap between the casting rolls is such as to maintain separation between the solidified shells at the nip and form a semi-solid metal in the space between the shells through the nip, and is, at least in part, subsequently solidified between the solidified shells within the cast strip below the nip. In one embodiment, the casting rolls 12 may be configured to provide a gap at the nip 18 through which thin cast strip 21 less than 5 mm in thickness can be cast.

FIG. 9 shows the twin roll caster producing thin cast steel strip 21 which is subjected to thermal cycling for the purpose of generally refining the grain size of the thin cast strip of steel. In one embodiment, shown, the cast strip 21 may pass across guide table 30 to a pinch roll stand 31, comprising pinch rolls 31A. Upon exiting the pinch roll stand 31, the thin cast strip may pass through a hot rolling mill 32, comprising a pair of work rolls 32A, and backup rolls 32B, forming a gap capable of hot rolling the cast strip delivered from the casting rolls, where the cast strip is hot rolled to reduce the strip to a desired thickness, improve the strip surface, and improve the strip flatness. The hot rolled cast strip then passes onto a run-out table 33 and into a first cooler 40 (a first cooling area or compartment), where the strip may be cooled by contact with a coolant, such as water, supplied via water jets or other suitable means, and by convection and radiation. After passing through the first cooler 40, the metal strip 21 moves into a furnace 50 (a heating area or compartment) where, as is further detailed below, the strip 21 is reheated for a specific duration of time at a temperature that at least partially reaustenitizes the metal strip 21. After departing the furnace 50, the temperature of the metal strip 21 is rapidly reduced in a recooler 60 (a second cooling area or compartment) so that the metal strip 21 then comprises a finer martensite from a prior finer austenite. The thermal cycled cast metal strip 21 may then pass through a second pinch roll stand 91 having pinch rolls 91A to provide tension of the cast strip, and then to a coiler 92. In other variations, the furnace, or any other heating mechanism configured to perform the reheating step recited in the methods discussed previously and the recooler, or any other cooling mechanism configured to perform the rapid recooling step recited in the methods discussed previously, may instead be arranged off line from the strip casting system to separately reheat and recool the thin metal strip formed by the strip casting system.

The general configuration of the twin roll caster shown in FIGS. 9 and 10, and described above, has the advantage of producing a thin cast metal strip 21 with a refined (reduced) grain size. The hot strip 21 exiting the cast roller 12 has a relatively coarse austenitic structure (see, e.g., FIGS. 4 and 6), where—without the benefit of the thermal cycling described herein—the austenite grain size may typically be in the range of 100 to 300 microns. If this hot strip 21 is quenched to form a martensitic steel strip, the coarse austenite grain size will lead to a martensitic steel strip with more limited ductility and may be prone to hydrogen embrittlement. However, the hot rolling of the strip 21 and thermal cycling to which it is subjected by the cooler 40, furnace 50 and recooler 60 modifies the metallurgical structure of the strip as it comes off the strip caster so as to produce a final strip 21 product that is characterized by improved ductility, reduced risk of hydrogen embrittlement and other improved mechanical properties. In various embodiments of the invention, the reduced susceptibility to hydrogen embrittlement is attributable to the production of a strip 21 with finer martensite from finer prior austenite where at least 75% of the austenite grains have a grain size of ≤15 μm, ≤10 μm, or ≤5 μm.

In various embodiments, the method of making thin metal strip with finer martensite from finer prior austenite may include the step of providing a pair of counter-rotatable casting rolls 12 having casting surfaces 12A laterally positioned to form a gap at a nip 18 between the casting rolls 12 through which thin strip 21 less than 5 mm in thickness can be cast. The method may also comprise the step of providing a metal delivery system adapted to deliver molten metal above the nip 18 to form a casting pool 19 supported on the casting surfaces 12A of the casting rolls 12 and confined at the ends of the casting rolls by a pair of side dams. In any such step of providing the pair of casting rolls or of providing the metal delivery system, the step may include assembling the same. The method may further require the delivery of a molten metal to the molten metal delivery system so as to produce an as-cast steel sheet that is characterized as an alloy or carbon steel. In one specific embodiment, the as-cast metal strip produced according to the method may have a composition comprising, by weight, between 0.20% and 0.35% carbon, less than 1.0% chromium, less than 1.0% nickel, between 0.7% and 2.0% manganese, between 0.10% and 0.50% silicon, between 0.1% and 1.0% copper, less than 0.08% niobium, less than 0.08% vanadium, less than 0.5% molybdenum, silicon killed with less than 0.01% aluminum, with the remainder being iron and impurities resulting from melting. The method may produce a metal strip of this composition by the step of counter rotating the casting rolls 12 to form metal shells on the casting surfaces 12A of the casting rolls 12 that are brought together at the nip 18 to deliver thin strip 21 downwardly for further processing. In one embodiment, counter rotating the casting rolls 12 to form metal shells on the casting surfaces 12A of the casting rolls 12 may occur at a heat flux greater than 10 $MW/m^2$.

In some embodiments, the method may include the step of moving the metal strip 21 across a guide table 30 to a pinch roll stand 31, comprising pinch rolls 31A. The method may include moving the thin strip 21 directly from the casting rolls 12, or directly from the pinch rolls 31A, so that it next passes through a hot mill 32 to reduce the thickness of the strip while it is in line with the caster. The strip 21 may be passed through the hot mill to reduce the as-cast thickness before the strip 21 is cooled for the first time to a temperature at which austenite in the steel transforms to martensite. The hot solidified strip may be passed through the hot mill while at an entry temperature in the range 800° C. to 1100° C., preferably at a temperature of the order of 1050° C. Passing the strip 21 through the hot mill 32 enables improved gauge control and reduction of porosity in the final strip product.

Figure 8:
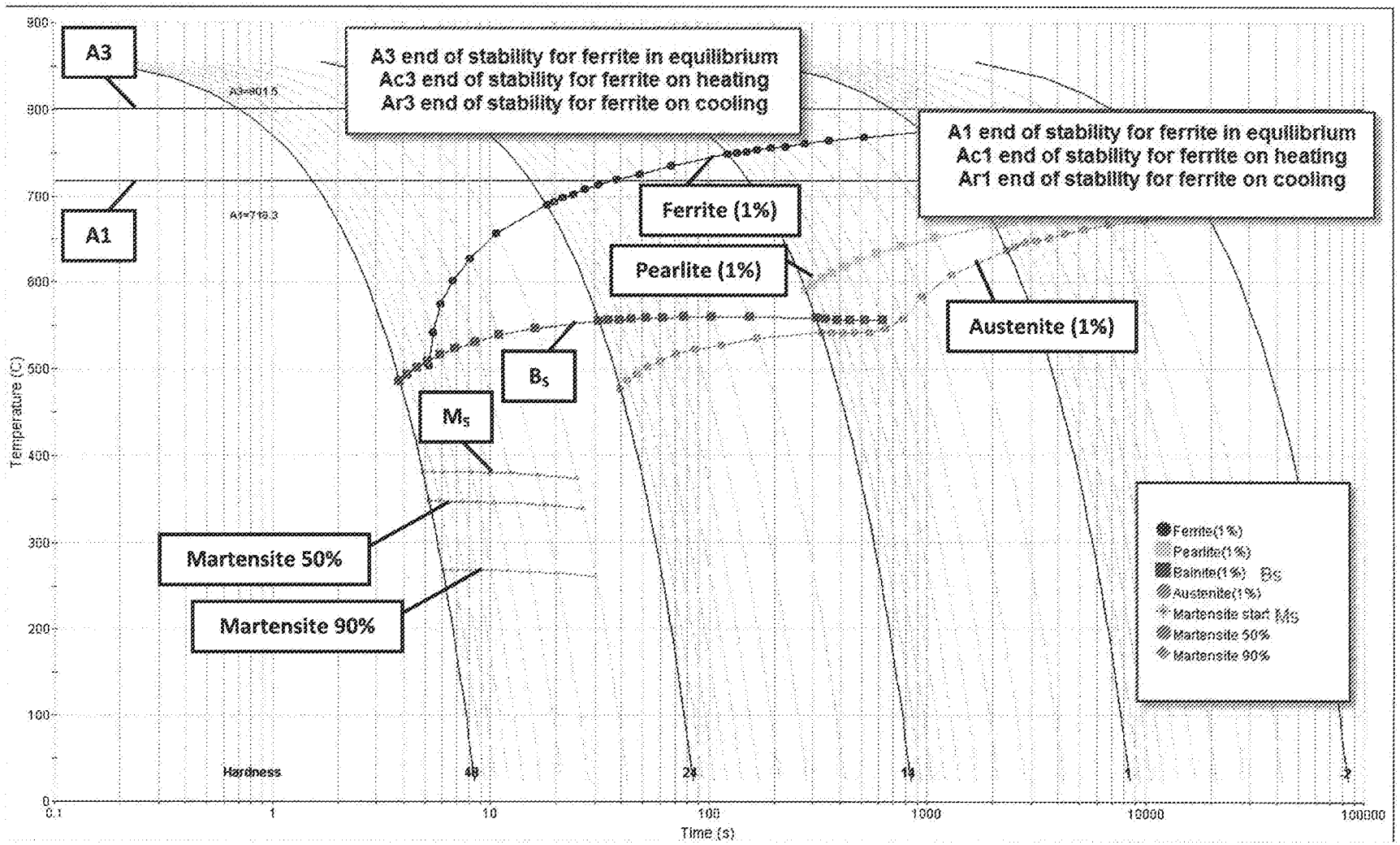
FIG. 8 is a continuous cool transformation (CCT) diagram for steel.

After the strip 21 exits the hot mill 32, the strip 21 may be cooled for the first time to a temperature at which the austenite in the steel transforms to martensite by cooling to a temperature equal to or less than ≤600° C. Cooling may be achieved by subjecting the strip to water sprays or gas blasts on a run out table 33 in a cooler 40 or by roll cooling. The cooler 40 may be configured to reduce the temperature of the strip 21 at the rate of about 100° C. to 200° C. per second from the hot mill temperature of typically 900° C. down to a temperature of below 600° C. This must be below the bainite or martensite start transformation temperature ($B_S$ or $M_S$, respectively), each of which are dependent on the particular composition. The cooling must be sufficiently rapid to avoid the onset of appreciable ferrite, which is also influenced by composition. Any cooling mechanism(s) or methods may be employed, as noted herein as would otherwise be appreciated by one of ordinary skill in the art. The interplay between transformation temperatures and cooling rates are typically presented in a CCT diagram (for example, see an exemplary CCT diagram in FIG. 8). In the exemplary CCT diagram shown in FIG. 8, bainite start transformation temperature $B_S$ and martensite start transformation temperature $M_S$ are each shown, together with transformation temperatures $A_1$ and $A_3$. In passing through the cooler, the austenite in the strip 21 is transformed to bainite and/or martensite. Specifically, cooling the strip 21 to below 600° C. causes a transformation of the coarse austenite wherein a distribution of fine iron carbides are precipitated within the bainite and/or martensite. The iron carbides are precipitated below the transformation temperature $Ac_3$ during the cooling or the reheating stage, described further below.

After the thin metal strip is cooled to a temperature below about 600° C., the method next includes reheating the thin metal strip for the purpose of reaustenizing the thin metal strip. In the embodiment shown in FIG. 9, the step of reheating includes passing the strip through a heat mechanism forming a furnace 50, such as an electrical resistance heater or induction furnace, or in other variations, any other desired heating mechanism may be employed. In particular embodiments, the strip 21 is reheated to a temperature above the transformation temperature $Ac_3$ (in the disclosed composition, greater than 750° C.) and then held at that temperature for a specified time. Depending on the reheating temperature, the strip 21 may be partially or completely reaustenitized. In one embodiment, the strip 21 is reheated to between 750° C. and 900° C. In one embodiment, the thin strip 21 is held at the reheat temperature of between 750° C. and 900° C. for between 2 and 20 seconds. In other embodiments, the thin strip 21 is reheated to between 825° C. and 900° C. and held at the reheat temperature for between 2 and 20 seconds. In various embodiments, the strip 21 may be reheated to approximately 825° C. and then held for a period of 2, 5, 10 or 15 seconds at this temperature. In still other embodiments, the strip 21 may be reheated to a temperature of approximately 825° C., 775° C., or 800° C. and held for a period of two, ten, or twenty seconds. As can be seen with reference to FIG. 2, the reheating temperature and hold times produce a cast strip 21 with varying prior austenite grain sizes. Notably, the prior austenite grain sizes—of between 4 μm and 9 μm—for strip that is reheated and treated to thermal cycling according to the invention are significantly smaller than the 100-300 μm grain sizes of austenite that is not thermal cycled.

In the process of reheating the thin metal strip 21 to a reheating temperature at or above a transition temperature $Ac_3$, when the strip is heated to just above the start transformation temperature $Ac_1$, new austenite initially forms at carbides. In the process of reheating the metal strip 21 above the start transformation temperature $Ac_1$, new austenite grains nucleate near these carbides (where the eutectoid composition exists locally), with the number and distribution of the new austenite grains depending on the distribution of the carbides. On further reheating, or holding at temperatures above the transformation temperature $Ac_3$, the austenite grains will grow, thereby increasing the austenite grain size. In some embodiments, a carbide distribution may be created by tempering the as cooled martensitic steel.

In some embodiments, after the strip 21 is reheated and held for a predetermined time, the strip 21 is rapidly recooled in a recooler 60 to a temperature less than 200° C. In other embodiments, the strip 21 is rapidly recooled in the recooler 60 to less than 100° C. In some embodiments, the metal strip 21 is rapidly quenched in the recooler 60 at a rate of approximately 700° C. per second. The rapid recooling of the metal strip 21 to 200° C. or 100° C. brings the strip 21 to a temperature significantly below the transformation temperature $M_S$. The material is transformed by this rapid recooling to produce a fine grained steel that is predominantly martensite (that is, at least 75% by volume martensite) having prior austenite grain sizes equal to or less than 15 microns, and in certain instances, equal to or less than 10 microns or 5 microns.

In view of the foregoing, the following list identifies certain specific embodiments of the subject matter described and/or shown herein, which may be expanded or narrowed as desired:

1. A method of making thin metal strip with finer martensite from finer prior austenite comprising:
   - providing a pair of counter-rotatable casting rolls having casting surfaces laterally positioned to form a gap at a nip between the casting rolls through which a thin metal strip having a thickness of less than 5 mm can be cast,
   - providing a metal delivery system adapted to deliver molten metal above the nip to form a casting pool, the casting pool being supported on the casting surfaces of the pair of counter-rotatable casting rolls and confined at the ends of the casting rolls,
   - delivering a molten metal to the metal delivery system to produce a thin metal strip comprising the following composition: by weight, between 0.20% and 0.35% carbon, less than 1.0% chromium, less than 1.0% nickel, between 0.7% and 2.0% manganese, between 0.10% and 0.50% silicon, between 0.1% and 1.0% copper, less than 0.08% niobium, less than 0.08% vanadium, less than 0.5% molybdenum, silicon killed with less than 0.01% aluminum;
   - delivering the molten metal from metal delivery system above the nip to form the casting pool;
   - counter rotating the pair of counter-rotatable casting rolls to form metal shells on the casting surfaces of the casting rolls that are brought together at the nip to deliver the thin metal strip downwardly, the thin metal strip having a thickness less than 5 mm,
   - cooling the thin metal strip to a temperature equal to or less than a bainite or a martensite start transformation temperature $B_S$ or $M_S$ to thereby form bainite and/or martensite, respectively, within the thin metal strip,
   - reheating the thin metal strip to a reheat temperature equal to or greater than transformation temperature $Ac_3$ and holding the thin metal strip at the reheat temperature for at least 2 seconds and thereby forming austenite within the thin metal strip with at least 75% of austenite grains having a grain size equal to or less than 15 μm, and
   - rapidly recooling the thin metal strip to a temperature equal to or less than the martensite start transformation temperature $M_S$ and thereby providing finer martensite within the thin metal strip from a finer prior austenite, where at least 75% of finer prior austenite grains have a grain size equal to or less than 15 μm.

2. The method of 1., where counter rotating the casting rolls to form metal shells on the casting surfaces of the casting rolls is performed with a heat flux greater than 10 $MW/m^2$.
3. The method of any one of 1. to 2., where in the step of reheating, the reheating temperature is equal to or greater than 750° C.
4. The method of any one of 1. to 3., where in the step of reheating, the reheating temperature is between 750° C. and 900° C.
5. The method of any one of 1. to 4., where in the step of reheating, the reheating temperature is between 825° C. and 900° C.
6. The method of any one of 1. to 5., where in reheating the thin metal strip, the reheat temperature is held up to 20 seconds.
7. The method of any one of 1. to 6., where in the step of rapidly recooling, the thin strip is rapidly recooled to a temperature less than 100° C.
8. The method of any one of 1. to 7., where at least 75% of the grains of the austenite formed in the step of reheating have a grain size equal to or less than 10 μm.
9. The method of any one of 1. to 8., where at least 75% of the grains of the finer prior austenite have a grain size equal to or less than 10 μm.
10. The method of any one of 1. to 9., where in the step of cooling, the temperature to which the thin metal strip is cooled is equal to or less than 600° C.
11. The method of any one of 1. to 10., where in the step of cooling, the thin metal strip is cooled to a temperature equal to or less than the martensite start transformation temperature to form martensite within the thin metal strip.
12. The method of any one of 1. to 11., where in the step of rapidly recooling, the thin metal strip is recooled to a temperature equal to or less than the martensite start transformation temperature to form finer martensite within the thin metal strip.
13. The method of any one of 1. to 12., where in the step of rapidly recooling, the temperature is equal to or less than 200° C.
14. A thin metal strip comprising:

a thickness less than 5 mm;

by weight, between 0.20% and 0.35% carbon, less than 1.0% chromium, less than 1.0% nickel, between 0.7% and 2.0% manganese, between 0.10% and 0.50% silicon, between 0.1% and 1.0% copper, less than 0.08% niobium, less than 0.08% vanadium, less than 0.5% molybdenum, silicon killed with less than 0.01% aluminum;

martensite characterized as having at least 75% of prior austenite grains having a grain size equal to or less than 15 μm.

While it has been described with reference to certain embodiments, it will be understood by those skilled in the art that various changes may be made and equivalents may be substituted without departing from scope. In addition, many modifications may be made to adapt a particular situation or material to the teachings without departing from its scope. Therefore, it is intended that it not be limited to the particular embodiments disclosed, but that it will include all embodiments falling within the scope of the appended claims.

The following is claimed:

1. A thin metal strip comprising:

an as cast thickness less than 5 mm;

by weight, between 0.20% and 0.35% carbon, less than 1.0% chromium, less than 1.0% nickel, between 0.7% and 2.0% manganese, between 0.10% and 0.50% silicon, between 0.1% and 1.0% copper, less than 0.08% niobium, less than 0.08% vanadium, less than 0.5% molybdenum, silicon killed with less than 0.01% aluminum;

martensite from prior austenite grains, where at least 75% of the prior austenite grains have a grain size equal to or less than 10 μm upon a first thermal cycle.

2. The thin metal strip of claim 1, where the martensite from prior austenite grains are formed by cooling the thin metal strip to a temperature equal to or less than a bainite or a martensite start transformation temperature ($B_S$ or $M_S$) after the thin strip casting, reheating the thin metal strip to a reheat temperature equal to or greater than transformation temperature $Ac_3$ and holding the thin metal strip at the reheat temperature for at least 20 seconds thereby forming the austenite within the thin metal strip with at least 75% of austenite grains having the grain size equal to or less than 10 μm, and rapidly recooling the thin metal strip at a quenching rate equal to or greater than 100° C./s to a temperature equal to or less than the martensite start transformation temperature $M_S$ and thereby providing finer martensite within the thin metal strip from prior austenite, where at least 75% of prior austenite grains have the grain size equal to or less than 10 μm.

3. The thin metal strip of claim 1, where the as cast thickness of less than 5 mm is cast through a pair of counter-rotatable casting rolls having casting surfaces laterally positioned to form a gap at a nip between the casting rolls through which the thin metal strip is cast where the pair of counter-rotatable casting rolls are counter rotated to form metal shells on the casting surfaces of the casting rolls with a heat flux greater than 10 $MW/m^2$.

4. The thin metal strip of claim 2, where the reheating temperature is equal to or greater than 750° C.

5. The thin metal strip of claim 2, where the reheating temperature is between 750° C. and 900° C.

6. The thin metal strip of claim 2, where the reheating temperature is between 825° C. and 900° C.

7. The thin metal strip of claim 2, where the reheating temperature is held up to 20 seconds.

8. The thin metal strip of claim 2, where the temperature to which the thin metal strip is initially cooled is equal to or less than 600° C.

9. The thin metal strip of claim 2, where the thin strip is rapidly recooled to a temperature less than 100° C.

10. The thin metal strip of claim 2, where the thin strip is rapidly recooled to a temperature equal to or less than 200° C.

11. A method of making thin metal strip with finer martensite from finer prior austenite comprising:

providing a pair of counter-rotatable casting rolls having casting surfaces laterally positioned to form a gap at a nip between the casting rolls through which a thin metal strip having a thickness of less than 5 mm can be cast, providing a metal delivery system adapted to deliver molten metal above the nip to form a casting pool, the casting pool being supported on the casting surfaces of the pair of counter-rotatable casting rolls and confined at the ends of the casting rolls, delivering a molten metal to the metal delivery system to produce a thin metal strip comprising the following composition: by weight, between 0.20% and 0.35% carbon, less than 1.0% chromium, less than 1.0% nickel, between 0.7% and 2.0% manganese, between 0.10% and 0.50% silicon, between 0.1% and 1.0% copper, less than 0.08% niobium, less than 0.08% vanadium, less than 0.5% molybdenum, silicon killed with less than 0.01% aluminum;

delivering the molten metal from metal delivery system above the nip to form the casting pool;

counter rotating the pair of counter-rotatable casting rolls to form metal shells on the casting surfaces of the casting rolls that are brought together at the nip to deliver the thin metal strip downwardly, the thin metal strip having a thickness less than 5 mm, cooling the thin metal strip to a temperature equal to or less than a bainite or a martensite start transformation temperature $B_S$ or $M_S$ to thereby form bainite and/or martensite, respectively, within the thin metal strip, reheating the thin metal strip to a reheat temperature equal to or greater than transformation temperature $A_C$; and holding the thin metal strip at the reheat temperature for at least 2 seconds and thereby forming austenite within the thin metal strip with at least 75% of austenite grains having a grain size equal to or less than 10 μm, and rapidly recooling the thin metal strip to a temperature equal to or less than the martensite start transformation temperature $M_S$ and thereby providing finer martensite within the thin metal strip from a finer prior austenite, where at least 75% of finer prior austenite grains have a grain size equal to or less than 10 μm upon a first thermal cycle; thereby producing the thin metal strip of claim 1.

12. The method of claim 11, where counter rotating the casting rolls to form metal shells on the casting surfaces of the casting rolls is performed with a heat flux greater than 10 MW/ $m^2$.

13. The method of claim 11, where in the step of reheating, the reheating temperature is equal to or greater than 750° C.

14. The method of claim 11, where in the step of reheating, the reheating temperature is between 750° C. and 900° C.

15. The method of claim 11, where in the step of reheating, the reheating temperature is between 825° C. and 900° C.

16. The method of claim 11, where in reheating the thin metal strip, the reheat temperature is held up to 20 seconds.

17. The method of claim 11, where in the step of rapidly recooling, the thin strip is rapidly recooled to a temperature less than 100° C.

18. The method of claim 11, where in the step of cooling, the temperature to which the thin metal strip is cooled is equal to or less than 600° C.

19. The method of claim 11, where in the step of cooling, the thin metal strip is cooled to a temperature equal to or less than the martensite start transformation temperature to form martensite within the thin metal strip.

20. The method of claim 11, where in the step of rapidly recooling, the thin metal strip is recooled to a temperature equal to or less than the martensite start transformation temperature to form finer martensite within the thin metal strip.

21. The method of claim 11, where in the step of rapidly recooling, the temperature is equal to or less than 200° C.

* * * * *